US007982675B2

(12) United States Patent
Tsujimura et al.

(10) Patent No.: US 7,982,675 B2
(45) Date of Patent: Jul. 19, 2011

(54) WIRELESS COMMUNICATION DEVICE AND ANTENNA

(75) Inventors: Akihiro Tsujimura, Kokubunji (JP); Takashi Amano, Soka (JP)

(73) Assignee: Kabushiki Kaisha TOSHIBA, Tokyo (JP)

( * ) Notice: Subject to any disclaimer, the term of this patent is extended or adjusted under 35 U.S.C. 154(b) by 569 days.

(21) Appl. No.: 12/110,774

(22) Filed: Apr. 28, 2008

(65) Prior Publication Data

US 2009/0058737 A1 Mar. 5, 2009

(30) Foreign Application Priority Data

Sep. 5, 2007 (JP) ..... P2007-230750

(51) Int. Cl.
*H01Q 1/24* (2006.01)

(52) U.S. Cl. ..... 343/702; 343/873

(58) Field of Classification Search ..... 343/700 MS, 343/702, 873

See application file for complete search history.

(56) References Cited

U.S. PATENT DOCUMENTS 5,995,854 A 11/1999 Wilson
2005/0275600 A1 12/2005 Benton et al.
2006/0176225 A1 8/2006 Annamaa et al.
2006/0197712 A1 9/2006 Niemi et al.

FOREIGN PATENT DOCUMENTS

| | | | |
|---|---|---|---|
| GB | 2 293 274 | A | 3/1996 |
| JP | 2005-295578 | A | 10/2005 |
| WO | WO 94/21054 | A1 | 9/1994 |
| WO | WO 02/071536 | A1 | 9/2002 |
| WO | WO 2005/011053 | A1 | 2/2005 |
| WO | WO 2005/024996 | A1 | 3/2005 |
| WO | WO 2006/106982 | A1 | 10/2006 |

OTHER PUBLICATIONS

Extended European Search Report dated Oct. 29, 2008, issued in a corresponding European Application.

*Primary Examiner* — Tho G Phan

(74) *Attorney, Agent, or Firm* — Holtz, Holtz, Goodman & Chick, PC

(57) ABSTRACT

A wireless communication device includes: a case that includes a dielectric member made of a first dielectric material, the dielectric member being coated with a coating layer made of a second dielectric material; a wireless communication circuit that is housed in the case; an antenna element that is electrically connected to the wireless communication circuit, the antenna element being made of a conductive material and provided on a surface of the dielectric member; and an adhesive layer that is disposed between the antenna element and the dielectric member to adhere the antenna element onto the dielectric member, the adhesive layer being made of a third dielectric material.

19 Claims, 4 Drawing Sheets

WIRELESS COMMUNICATION DEVICE AND ANTENNA

RELATED APPLICATION(S)

The present disclosure relates to the subject matters contained in Japanese Patent Application No. 2007-230750 filed on Sep. 5, 2007, which are incorporated herein by reference in its entirety.

FIELD

The present invention relates to a wireless communication device and an antenna, which are suitable in use for a mobile communication system.

BACKGROUND

There is known an antenna component that is three-dimensionally designed by having an antenna element mounted on a surface of a dielectric substrate. The antenna component is mounted directly on a case of compact wireless communication device, such as a cellular phone, or on a circuit board, and is used as a built-in antenna. The antenna component is often called molded interconnect device (MID) antenna from its structural configuration.

The MID antenna is configured by providing an antenna as a compact modular component to be installed in a wireless communication device in the same manner as with other general components. However, limitations are imposed on a resin in terms of characteristics such as whether or not the resin can be subjected to dual molding, and whether or not the resin can be easily plated. The MID antenna uses a resin that is deficient in strength and undesirable for use as a case of a slim-type wireless communication device. Accordingly, the MID antenna is provided as a component separate from the case of the wireless communication device. Therefore, in order to simplify processes by means of further reducing the number of components, forming an antenna element on the surface (an interior surface or an exterior surface) of a case of the wireless communication device in place of use of the MID antenna is desirable. In general, when mounted on the wireless communication device, the antenna requires to be fine-adjusted due to the unignorable influence of metallic components disposed around the antenna. When an antenna is formed by use of a metal mold as in the case of the MID antenna, a long period is required for fine adjustment. Moreover, a plurality of metal molds may be required for performing the fine adjustment, and there is also a problem of consumption of a considerable initial investment before starting mass production of the antenna.

Conventionally, there is known a technique for forming conductor pattern in a portion of a case of a wireless communication device, connecting to a feeding point, and operating the pattern as an antenna. An example of such technique is disclosed in JP-A-2005-295578.

The document JP-A-2005-295578 discloses a techniques for configuring a built-in antenna, which to form one of cases of a clamshell cellular phone with a conductive material or to form the one of the cases with an insulating material and providing a conductor layer on the surface of the case; and connecting the case to a feeding point by being interposed therebetween with a conductive member that is included in a hinge mechanism. According to this configuration, the case of the cellular phone serves as a portion of the antenna.

Among the techniques disclosed in the document JP-A-2005-295578, the technique for forming the conductor layer for an antenna element on the surface of the case formed from an insulating material is more advantageous in terms of manufacturing cost than the technique of forming the case from a conductive material. However, the document JP-A-2005-295578 fails to disclose specifics about how to form the antenna element on the surface of the case made of an insulating material and how to ensure an antenna characteristic.

SUMMARY

One of objects of the present invention is to ensure a characteristic of an antenna including an antenna element formed on the surface of a case made of a insulating dielectric material. The present invention also provides an antenna that is printable on a reinforced dielectric material that is preferable to be used for a case of a wireless communication device to reduce the thickness while having a required strength.

According to a first aspect of the invention, there is provided a wireless communication device including: a case that includes a dielectric member made of a first dielectric material, the dielectric member being coated with a coating layer made of a second dielectric material; a wireless communication circuit that is housed in the case; an antenna element that is electrically connected to the wireless communication circuit, the antenna element being made of a conductive material and provided on a surface of the dielectric member; and an adhesive layer that is disposed between the antenna element and the dielectric member to adhere the antenna element onto the dielectric member, the adhesive layer being made of a third dielectric material.

According to a second aspect of the invention, there is provided an antenna including: a case that includes a dielectric member made of a first dielectric material, the dielectric member being coated with a coating layer made of a second dielectric material; an antenna element that is made of a conductive material and provided on a surface of the dielectric member; and an adhesive layer that is disposed between the antenna element and the dielectric member to adhere the antenna element onto the dielectric member, the adhesive layer being made of a third dielectric material.

According to a third aspect of the invention, there is provided a wireless communication device including: a casing means for accommodating electronic components, the casing means including a dielectric member made of a first dielectric material, the dielectric member being coated with a coating layer made of a second dielectric material; a wireless communication means for performing wireless communication, the wireless communication means being housed in the casing means; an antenna means for transmitting and receiving radio wave, the antenna means being electrically connected to the wireless communication means, the antenna means being made of a conductive material and provided on a surface of the dielectric member; and an adhesive means for adhering the antenna means onto the dielectric member by being disposed between the antenna means and the dielectric member, the adhesive means being made of a third dielectric material.

According to a fourth aspect of the invention, there is provided an antenna including: a casing means for accommodating electronic components, the casing means including a dielectric member made of a first dielectric material, the dielectric member being coated with a coating layer made of a second dielectric material; an antenna means for transmitting and receiving radio wave, the antenna means being made of a conductive material and provided on a surface of the dielectric member; and an adhesive means for adhering the antenna means onto the dielectric member by being disposed between the antenna means and the dielectric member, the adhesive means being made of a third dielectric material.

DETAILED DESCRIPTION OF THE EMBODIMENTS

Figure 1:
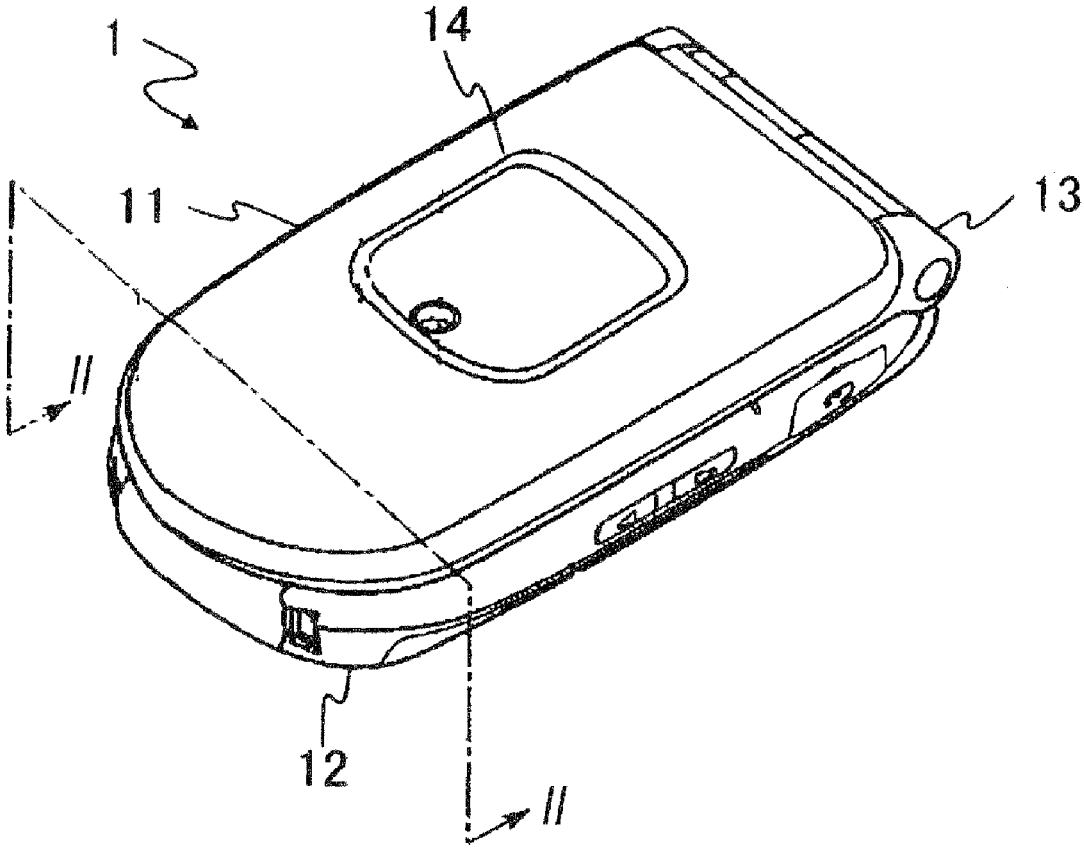
FIG. 1 is a perspective view showing external appearance of a wireless communication device according to a first embodiment of the present invention.

Embodiments of the present invention will be described with reference to FIGS. 1-7. In the following description, directions, such as horizontal and vertical directions and up, down, right, and left, are referred to with postures shown in the drawings unless otherwise specified. Moreover, same reference numerals designate same or similar components throughout the drawings.

FIG. 1 is a perspective view showing an external appearance of wireless communication device 1 according to a first embodiment of the present invention. The wireless communication device 1 has a first case 11 and a second case 12 being connected by a hinge portion 13 to be foldable. FIG. 1 shows a state where the first case 11 and the second case 12 are closed. The first case 11 has an auxiliary display 14 having a display device such as a liquid-crystal display device.

Figure 2:
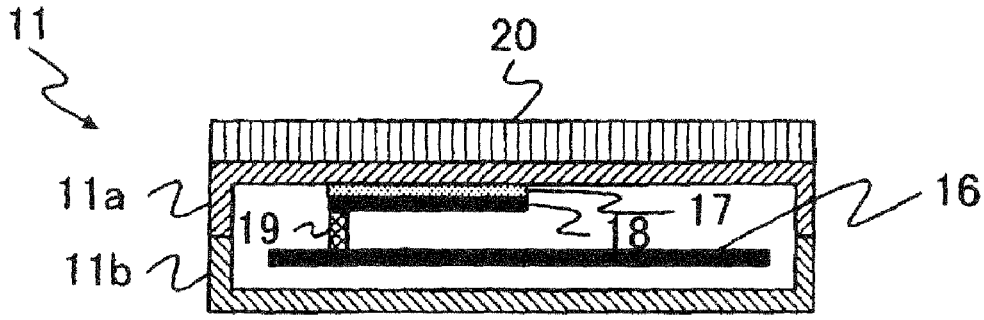
FIG. 2 is an internal cross-sectional view of a case of the wireless communication device shown in FIG. 1.

FIG. 2 is an internal cross-sectional view of the first case 11 taken along II-II line shown in FIG. 1. The first case 11 is formed by engaging an upper member 11*a* and a lower member 11*b*, which are both formed from a dielectric material, with each other in vertical direction. The first case 11 houses a substrate 16 on which a wireless communication circuit (not shown) and a feeding line formed from a conductor pattern are mounted.

An antenna element 18 is made of a conductive material on an interior surface of the upper member 11*a* sandwiching an adhesive layer 17 made of a dielectric material. The antenna element 18 is connected to the wireless communication circuit by the power feeding line of the substrate 16 and by a connection member 19. The connection member 19 may be a spring connector.

In order to form a conductor pattern on the surface of the dielectric material, there has been known a method for chemically roughening the surface by etching the surface and providing the surface with a plating layer by means of a so-called anchoring effect. However, in a compact wireless communication device, for example a cellular phone, a dielectric material exhibiting high mechanical strength is used for a base material for the case in order to reduce the thickness of the case, and hence a sufficient etching effect may not be yielded.

Accordingly, instead of etching the interior surface of the upper member 11*a*, an adhesive layer 17 of a type (an acrylic adhesive, an alkyd-based adhesive, an urethane-based adhesive, an epoxy-based adhesive, and the like), which is used as an undercoating covering the entirety or at least a portion of the interior surface, may be provided, and a medium mixed with a plating catalyst (ink) may be printed on the surface of the adhesive layer in conformance to the shape of the antenna element 18. In order to grow the plating by the catalyst, activation is induced by etching (differing from etching used for yielding the previously-described anchoring effect), thereby treating electroless plating. Thus, the antenna element 18 formed from a conductor pattern can be formed. Alternatively, electrolytic plating may also be performed after performing the electroless plating in order to increase the thickness of plating within a short period of time.

According to the antenna element 18 placed on the adhesive layer 17 as described above, the number of components can be reduced. A plurality of antenna elements can be formed simultaneously through a single process without involvement of occurrence of variations in mounting of components. Because the antenna elements are formed by use of printing technique, a reduction in initial cost due to elimination of metal molds and shortening of a lead time for fine adjustment can be attained. Further, when compared with a case where the antenna element 18 is arranged directly on the interior surface of the upper member 11*a*, an advantage of high selectively of a resin material for the upper member 11*a* (a wide range of choice) can be obtained as a result of intervention of the adhesive layer 17.

A coating layer 20 made of a dielectric material is provided so as to cover the entirety or a portion of an exterior surface of the upper member 11*a*. The coating layer 20 is made of a material such as a hardening resin. The coating layer 20 serves as designing surface paint for finishing the exterior surface of the wireless communication device 1. The coating layer 20 may also be an exterior panel made of a material such as a transparent or translucent resin. The coating layer 20 may also be formed as a designing surface formed by dual molding.

Figure 3:
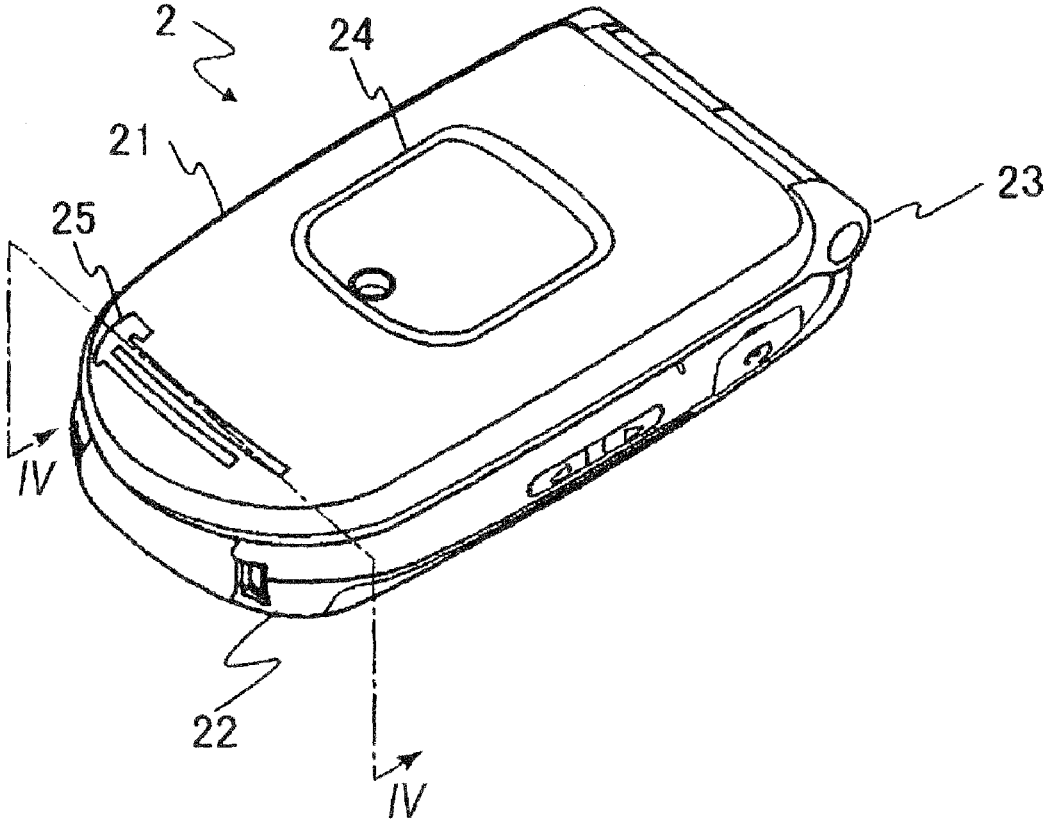
FIG. 3 is a perspective view showing external appearance of a wireless communication device according to a second embodiment of the present invention.

FIG. 3 is a perspective view showing the external appearance of wireless communication device 2 according to a second embodiment of the present invention. The wireless communication device 2 includes a first case 21 and a second case 22 being pivotably connected together by a hinge portion 23. FIG. 3 shows a state where the first case 21 and the second case 22 are closed. The first case 21 has a sub display 24 having a display device such as a liquid-crystal display device. An antenna element 25 made of a conductor pattern is formed on an exterior surface of the first case 21.

Figure 4:
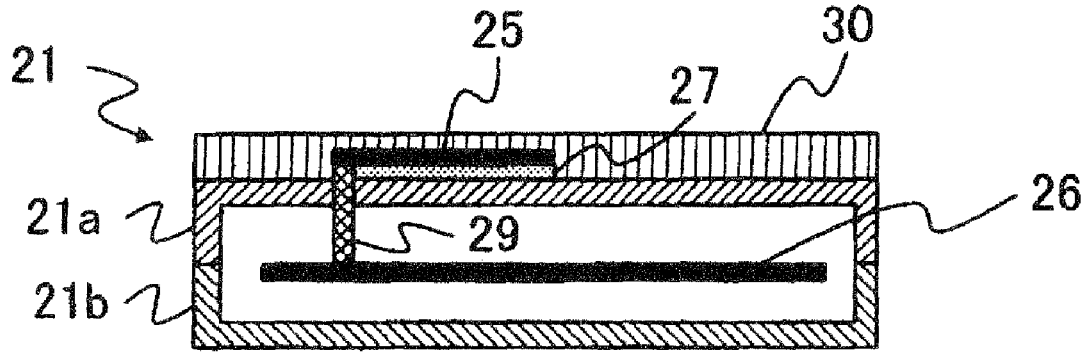
FIG. 4 is an internal cross-sectional view of a case of the wireless communication device shown in FIG. 3.

FIG. 4 is an internal cross-sectional view of the first case 21 taken along a IV-IV line shown in FIG. 3. The first case 21 includes an upper member 21*a* and a lower member 21*b*, which are formed from a dielectric material, being engaged together in the vertical direction. The first case 21 houses a substrate 26 on which a wireless communication circuit (not shown) and a feeding line made of a conductor pattern are mounted.

The antenna element 25 is formed on the exterior surface of the upper member 21*a* by being interposed therebetween with an adhesive layer 27 made of a dielectric material covering the entirety or a portion of the exterior surface. The antenna element 25 is connected to the wireless communication circuit via a power feeding line of the substrate 26 by a through hole penetrating through a space between the exterior surface and the interior surface of the upper member 21*a*, and by means of; for example, the connection member 29, such as a leaf spring formed from sheet metal and a spring connector. Alternatively, the antenna element 25 may also be connected to the front and the rear sides of the case; namely, the substrate 26 and a coating layer 30 to be described later, without passing through the upper member 21*a*.

As in the case of the adhesive layer 17 of the first embodiment, the adhesive layer 27 is made of a dielectric material of a type used as undercoating that covers the entirety or at least a portion of the exterior surface. A medium mixed with a plating catalyst (ink) is printed on the surface of the adhesive layer 27 in conformance to the shape of the antenna element 25 to form an ink layer. In order to grow plating by means of the catalyst, activation is induced by etching (differing from etching used for yielding the previously-described anchoring effect), thereby effecting electroless plating. Thus, the antenna element 25 formed from a conductor pattern can be formed. Alternatively, electrolytic plating may also be performed after electroless plating in order to increase the thickness of plating within a short period of time.

A coating layer 30 made of a dielectric material is provided on an exterior surface of the upper member 21*a* so as to cover the entirety or a portion of the antenna element 25. The coating layer 30 is made of a material such as a hardening resin and serves as designing surface paint used for finishing the exterior surface of the wireless communication device 1. The coating layer 30 may also be an exterior panel made of a transparent or translucent resin, or a design surface formed by dual molding.

As mentioned above, the antenna element 25 is placed on the adhesive layer 27, so that a reduction in the number of components, prevention of variations, which would otherwise arise at the time of mounting of components, and simultaneous fabrication of a plurality of antenna elements can be made through a single process. The antenna element 25 may be separated from the substrate 26 by being provided outside of the upper member 21, so that the volume of an actual antenna can be increased by an amount corresponding to the thickness of the upper member 21*a* and that enhancement of efficiency of the antenna and widening of a band become feasible. The antenna may be formed by use of the printing technique, a reduction in initial cost due to elimination of metal molds and shortening of a lead time for fine adjustment can be obtained. When compared with a case where the antenna element 25 is arranged directly on the exterior surface of the upper member 21*a*, there is yielded an advantage of high selectively of a resin material for the upper member 21*a* (a wide range of choice) being achieved as a result of intervention of the adhesive layer 27.

Figure 5:
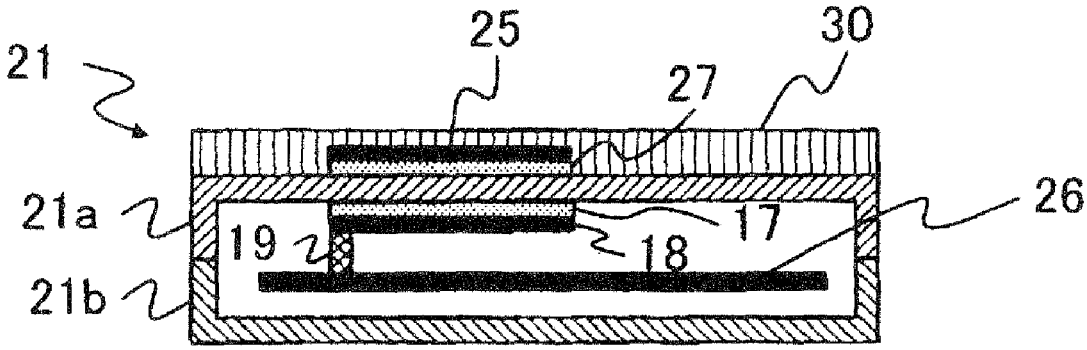
FIG. 5 is an internal cross-sectional view of a case of the wireless communication device having a configuration equivalent to a mixture of the configurations shown in FIGS. 2 and 4.

FIG. 5 is another example internal cross-sectional view of the first case 21 taken along the IV-IV line shown in FIG. 3, showing a configuration having a mixture of the configurations shown in FIGS. 2 and 4. In the drawings, reference numerals 17 through 19 are common to FIG. 2. Components that are same with those shown in FIG. 4 are denoted as same reference numerals 21, 21*a*, 21*b*, 25, 27, and 30.

In FIG. 5, the antenna element 18 is made of a conductive material on an interior surface of the upper member 21*a* via the adhesive layer 17 made of a dielectric material. As in FIG. 2, the antenna element 18 is connected to a wireless communication circuit of the substrate 26. The antenna element 25 is formed on the exterior surface of the upper member 21*a* by being interposed therebetween with the adhesive layer 27 formed from a dielectric material. As shown in FIG. 4, the antenna element 25 is connected to a wireless communication circuit of the substrate 26.

FIG. 5 shows a structure in which the antenna elements 18 and 25 are respectively formed on the interior surface and exterior surface of the upper member 21*a* by being interposed therebetween with the respective adhesive layers 17 and 27. The antenna element 25 may also be fed with electric power along with the antenna element 18 via the trough holes penetrating through the space between the exterior and interior surfaces of the upper member 21*a* (omitted from the drawings). Alternatively, the antenna element 25 may also be connected to the wireless communication circuit of the substrate 26 by being interposed therebetween with another connection member (not shown). For example, the antenna element 25 may also be connected to; for example, the front and back sides of the case; namely, the substrate 26 and the coating layer 30, without passing through the upper member 21*a*. The wireless communication circuit connected to the antenna element 18 and the wireless communication circuit connected to the antenna element 25 may also belong to a single system or respective different systems. A plurality of antenna elements may also be arranged in close proximity to one another.

As mentioned above, the antenna element 25 is placed on the adhesive layer 27, so that a reduction in the number of components, prevention of variations, which would otherwise arise at the time of mounting of components, and simultaneous fabrication of a plurality of antenna elements through a single process can be attained. The antenna element 25 is formed outside of the upper member 21*a*, so that the antenna element 25 can be separated from the substrate 26 and that the volume of an actual antenna can be increased by an amount corresponding to the thickness of the upper member 21*a*. A degree of freedom in design is enhanced by means of enhancement of efficiency of the antenna, widening of a frequency band width, and formation of the antenna element 18 on the interior surface of the upper member 21*a*. Thus, the possibility of a plurality of antenna elements being placed in close proximity to each other is also increased. Further, so long as the antenna can be implemented by means of printing, a reduction in initial cost due to elimination of metal molds and shortening of a lead time for fine adjustment can be attained. When compared with a case where the antenna element 25 or 18 is arranged directly on the interior or exterior surface of the upper member 21*a*, there is yielded an advantage of high selectively of a resin material for the upper member 21*a* (a wide range of choice) being achieved as a result of intervention of the adhesive layer 27 or 17.

Figure 6:
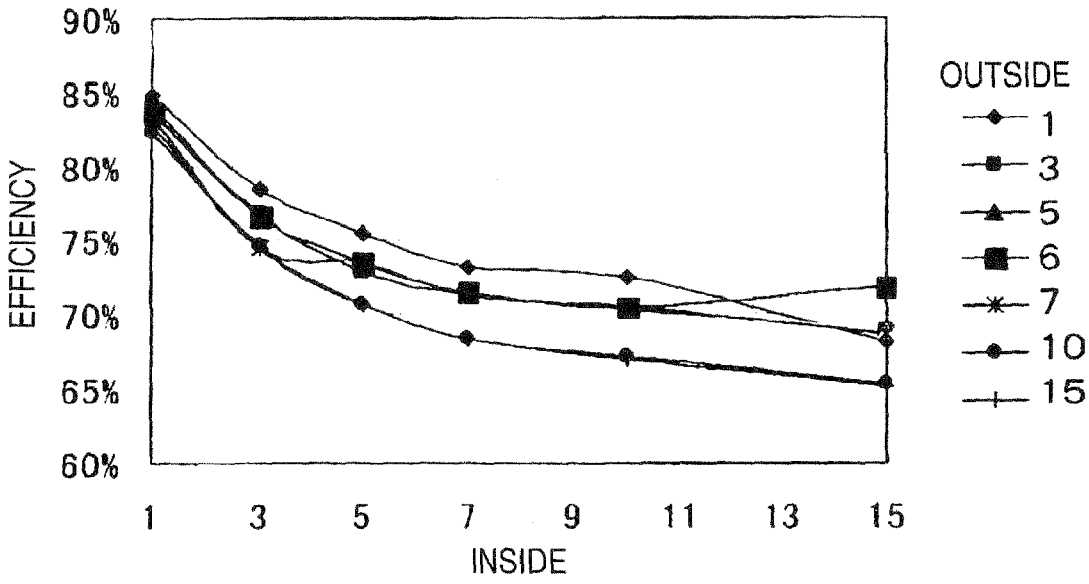
FIG. 6 is a view determining radiation efficiency of an antenna that includes the antenna element of the wireless communication device according to the first embodiment through simulation on the assumption that a relative permittivity of a case member is four and showing the thus-determined radiation efficiency.
Figure 7:
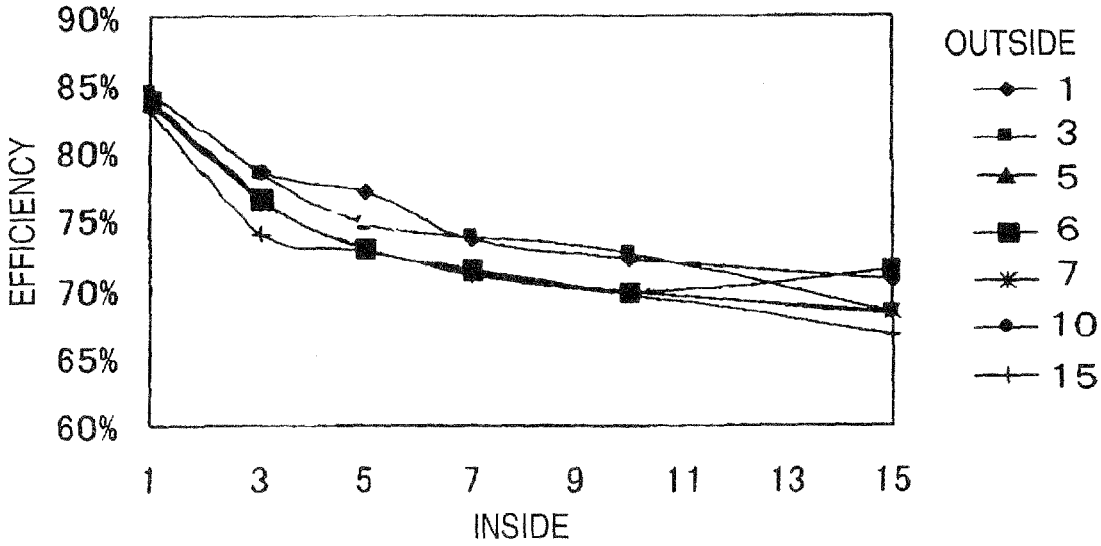
FIG. 7 is a view determining radiation efficiency of an antenna that includes the antenna element of the wireless communication device according to the first embodiment through simulation on the assumption that a relative permittivity of the case member is 2.4 and showing the thus-determined radiation efficiency.

By referring to FIGS. 6 and 7, there is described an example of a result of evaluation, performed through simulation, concerning a relationship between a characteristic of the dielectric material of the wireless communication device 1 embodying the basic configuration of the present invention and a characteristic of the antenna. FIG. 6 shows radiation efficiency of the antenna, including the antenna element 18, determined through simulation with reference to relative permittivity (1 through 15) of the adhesive layer 17 by means of taking, as parameters, a relative permittivity 4 of a dielectric material of the upper member 11*a* included in the configuration of the wireless communication device 1 and relative permittivity 1 through 15 of the coating layer 20.

The resonance frequency of the antenna element 18 varies from 2 gigahertz (GHz) to 2.5 GHz under influence of shortening of the wavelength caused by the dielectric substance located proximately to the antenna element 18. Further, a higher value of relative permittivity of practical dielectric substances serving as a member for the case of the wireless communication device is taken as the value (4) of the relative permittivity of the dielectric substance of the upper member 11*a*.

The horizontal axis (inside) shown in FIG. 6 shows a relative permittivity of the adhesive layer 17 located inside the first case 11. The vertical axis in the drawing represents radiation efficiency (percentage). Seven types of plots represent relative permittivity of the coating layer 20 located outside the first case 11 provided in "outside" on the right side of the drawing, respectively.

By referring to FIG. 6, conditions for radiation efficiency of the antenna including the antenna element 18 assuming, as a guide, a value of 70 percents or more are understood to be that the relative permittivity of the adhesive layer 17 and the relative permittivity of the coating layer 20 are roughly a value of seven or less. When the relative permittivity of the adhesive layer 17 assumes a value of seven or less and when the relative permittivity of the coating layer 20 assumes a value of seven or less, radiation efficiency does not fall below 70.

From the viewpoint of radiation efficiency, the lower limit for the relative permittivity of the adhesive layer 17 and the coating layer 20 does not need to be determined. When a material of the adhesive layer 17 and a material of the coating layer 20 are selected from practical dielectric substances, the lower limit of the relative permittivity is 2.7 or thereabouts.

FIG. 7 shows radiation efficiency of the antenna, including the antenna element 18, determined through simulation with reference to the relative permittivity (1 through 15) of the adhesive layer 17 by means of taking, as parameters, a relative permittivity 2.4 of a dielectric material of the upper member 11*a* and relative permittivity 1 through 15 of the coating layer 20.

The resonance frequency of the antenna element 18 varies from 2 gigahertz (GHz) to 2.5 GHz under influence of shortening of the wave length caused by the dielectric substance located closely proximate to the antenna element 18. Further, a lower value of relative permittivity of practical dielectric substances serving as a member for the case of the wireless communication device is taken as the value (2.4) of the relative permittivity of the dielectric substance of the upper member 11*a*.

As in FIG. 6, conditions for radiation efficiency of the antenna including the antenna element 18 assuming, as a guide, a value of 70 percents or more are understood, in FIG. 7, to be that the relative permittivity of the adhesive layer 7 and the relative permittivity of the coating layer 20 are roughly a value of seven or less.

In the internal cross-sectional view of the first case 11 of the wireless communication device 1 shown in FIG. 2, the antenna element 18 can be considered to be coated with a coating layer formed from a dielectric substance (air) having a relative permittivity of one. Further, in the internal cross-sectional view of the first case 21 of the wireless communication device 2 shown in FIG. 4, a coating layer formed from a dielectric substance (air) having a relative permittivity of one can be considered to be provided on a surface of the first member 21*a* opposite the surface where the antenna element 25 is formed.

In respect of the fact that a layer formed from a dielectric substance having a relative permittivity of seven or less is provided on both surfaces of the case member in which the antenna element is fabricated, the configuration of the wireless communication device 1 in which the relative permittivity of the coating layer 20 shown in FIG. 2 is set to a value of seven or less can be said to be equivalent to the configuration of the wireless communication device 2 in which the relative permittivity of the coating layer 30 shown in FIG. 4 is set to a value of seven or less.

Therefore, even in the configuration of the wireless communication device 2 shown in FIG. 4, the relative permittivity of the adhesive layer 27 and the relative permittivity of the coating layer 30 are set respectively to a value of seven or less, as shown in FIG. 6 or 7, whereby required radiation efficiency of the antenna including the antenna element 25 can be acquired. Even in the configuration, shown in FIG. 5, where the configuration of the wireless communication device 1 and the configuration of the wireless communication device 2 are mixed, required radiation efficiency of the antenna including the antenna elements 18 and 25 can be achieved by means of setting the relative permittivity of the adhesive layers 17 and 27 and the relative permittivity of the coating layer 30 to a value of seven or less, respectively, as shown in FIG. 6 or 7. Although influence on a related-art antenna element having only one layer of case is already ascertained, influence to an antenna element having three or more layers has not yet been ascertained.

In the configurations shown in FIGS. 2, 4 and 5, the thickness of the first member 11*a* or 21*a* appropriate ranges from 0.5 millimeters (mm) to 1 mm. The reason for this is as follows. A case of wireless communication device exhibits the function of protecting a substrate and components provided in the case of the wireless communication device. Under normal usage, the case should not be impaired. To this end, the base material of the case must be increased in thickness. However, in order to address a recent tendency toward slimming down of wireless communication device, a common method is to reinforce a dielectric material itself so that intensity is ensured even when the case is made as slim as possible. However, in order to perform injection molding, a resin must be charged into a metal mold. If the base material of the case is slimmed down, a resin fails to enter the mold. Further, a reinforced dielectric material exhibits low fluidity and does not enter so far as to a deep recess. Therefore, a value of 0.5 mm or more is usually required.

In FIGS. 2 and 4 or 5, the thickness of the adhesive layer 17 or 27 preferably ranges from 5 micrometers (μm) to 20 μm. The reason for this is as follows. Since the adhesive layer 17 or 27 is undercoating covering the entirety or a portion of the interior or exterior surface of the upper member 21*a*, the coating layer must assume a thickness of 5 μm or more in order to eliminate unpainted areas. Further, when the thickness of the adhesive layer is excessively large, a time consumed by drying processes required to enhance strength becomes longer. Hence, the thickness of the adhesive layer should preferably be set to a value of 20 μm or less.

In FIGS. 2 and 4 or 5, the thickness of the coating layer 20 or 30 preferably ranges from 5 micrometers (μm) to 20 μm. The reason for this is as follows. Since the coating layer 20 or 30 is a coating film covering the entirety or at least a portion of the design surface of the design surface, a thickness of 5 μm or more is required in order to eliminate an unpainted area on the same principle as that of the adhesive layer 17. When the thickness of the coating layer is too much, a time consumed by a drying process required to enhance intensity becomes longer, and hence the thickness is preferably set to a value of 20 μm or less.

According to the foregoing embodiments of the present invention, a radiation efficiency characteristic of an antenna, including the antenna element, can be ensured by means of selecting a layer structure and relative permittivity of respective layers during formation of an antenna element on the surface of the case of the wireless communication device.

In the above description, it is described that the antenna element 18 is adhered onto the dielectric member (upper member 11*a* of the first case 11) by the adhesive layer 17. However, the antenna element 18 may be adhered onto the dielectric member by any adhesive means having adhesive characteristic for adhering or joining, regardless of whether chemically, physically or mechanically, the antenna element 18 onto the dielectric member.

In the above description, the shape, configuration, and layout of the members forming the case and those of the antenna elements are described as only an example, however, those may be appropriately modified in order to meet with the design of the wireless communication device without departing from the scope of the claimed invention. For example, forming an antenna element on each of the surfaces of the case has been described in the embodiments. However, a plurality of antenna elements can be simultaneously fabricated without regard to a system. Moreover, the explanations have been given to the case where the adhesive layer is only one layer. However, in order to maintain adhesive properties, the adhesive layer may also be embodied as a plurality of layers depending on a dielectric material serving as the base material of the case. Moreover, the hinge portion may also be provided in numbers in the descriptions of the present patent application. The hinge portion may also be connected, as well as to the antenna power feeding section, to the ground of the circuit to serve as a short-circuiting member.

According to the present invention, an adhesive layer is provided to enable forming an antenna by printing without use of a dielectric material. Further, a characteristic of an antenna including the antenna element can be ensured by means of selecting a layer structure for forming an antenna element on the surface of a case made of a dielectric material and a characteristic of the material. An antenna can be formed by means of only a plate; without use of a metal mold; and by utilizing printing of an antenna for a reinforced dielectric material necessary for a case of wireless communication device which further comes down in thickness. Hence, an initial investment and a period of fine adjustment can also be reduced.

It is to be understood that the invention is not limited to the specific embodiment described above and that the present invention can be embodied with the components modified without departing from the spirit and scope of the present invention. The present invention can be embodied in various forms according to appropriate combinations of the components disclosed in the embodiments described above. For example, some components may be deleted from all components shown in the embodiments. Further, the components in different embodiments may be used appropriately in combination.

What is claimed is:

1. A wireless communication device comprising:

a case that includes a dielectric member made of a first dielectric material, and a cover layer made of a second dielectric material which covers an outer surface of the dielectric member;

a wireless communication circuit that is housed in the case;

an antenna element that is electrically connected to the wireless communication circuit, the antenna element being made of a conductive material and provided on an inner surface of the dielectric member; and an adhesive layer that is disposed between the antenna element and the dielectric member to adhere the antenna element onto the dielectric member, the adhesive layer being made of a third dielectric material.

2. The device according to claim 1, wherein the third dielectric material has a relative permittivity that is not more than seven.

3. The device according to claim 2, wherein the second dielectric material has a relative permittivity that is not more than seven.

4. The device according to claim 1, further comprising:

an additional antenna element that is electrically connected to the wireless communication circuit, the additional antenna element being made of a conductive material and provided on the outer surface of the dielectric member to be at least partially covered by the cover layer; and an additional adhesive layer that is disposed between the additional antenna element and the dielectric member to adhere the additional antenna element onto the dielectric member, the additional adhesive layer being made of a fourth dielectric material, wherein the third dielectric material has a relative permittivity that is not more than seven, and wherein the fourth dielectric material has a relative permittivity that is not more than seven.

5. The device according to claim 4, wherein the second dielectric material has a relative permittivity that is not more than seven.

6. The device according to claim 1, wherein the dielectric member has a thickness that is in a range from 0.5 mm to 1 mm, wherein the antenna element has a thickness that is not less than 10 μm, wherein the adhesive layer has a thickness that is in a range from 5 μm to 20 μm, and wherein the cover layer has a thickness that is in a range from 5 μm to 20 μm.

7. The device according to claim 6, further comprising:

an additional antenna element that is electrically connected to the wireless communication circuit, the additional antenna element being made of a conductive material and provided on the outer surface of the dielectric member to be at least partially covered by the cover layer; and an additional adhesive layer that is disposed between the additional antenna element and the dielectric member to adhere the additional antenna element onto the dielectric member, the additional adhesive layer being made of a fourth dielectric material, wherein the additional antenna element has a thickness that is not less than 10 μm, and wherein the additional adhesive layer has a thickness that is in a range from 5 μm to 20 μm.

8. The device according to claim 1, further comprising:

an additional antenna element that is electrically connected to the wireless communication circuit, the additional antenna element being made of a conductive material and provided on the outer surface of the dielectric member to be at least partially covered by the cover layer; and an additional adhesive layer that is disposed between the additional antenna element and the dielectric member to adhere the additional antenna element onto the dielectric member, the additional adhesive layer being made of a fourth dielectric material, wherein at least one of the antenna element and the additional antenna element is in close contact with the respective one of the adhesive layer and the additional adhesive layer by being interposed with an ink layer therebetween, the ink layer having a characteristic to grow plating.

9. An antenna comprising:

a case that includes a dielectric member made of a first dielectric material, and a cover layer made of a second dielectric material which covers an outer surface of the dielectric member;

an antenna element that is made of a conductive material and provided on an inner surface of the dielectric member; and an adhesive layer that is disposed between the antenna element and the dielectric member to adhere the antenna element onto the dielectric member, the adhesive layer being made of a third dielectric material.

10. The antenna according to claim 9, wherein the third dielectric material has a relative permittivity that is not more than seven.

11. The antenna according to claim 10, wherein the second dielectric material has a relative permittivity that is not more than seven.

12. The antenna according to claim 9, further comprising:

an additional antenna element that is made of a conductive material and provided on the outer surface of the dielectric member to be at least partially covered by the cover layer; and an additional adhesive layer that is disposed between the additional antenna element and the dielectric member to adhere the additional antenna element onto the dielectric member, the additional adhesive layer being made of a fourth dielectric material, wherein the third dielectric material has a relative permittivity that is not more than seven, and wherein the fourth dielectric material has a relative permittivity that is not more than seven.

13. The antenna according to claim 12, wherein the second dielectric material has a relative permittivity that is not more than seven.

14. The antenna according to claim 9, wherein the dielectric member has a thickness that is in a range from 0.5 mm to 1 mm, wherein the antenna element has a thickness that is not less than 10 μm, wherein the adhesive layer has a thickness that is in a range from 5 μm to 20 μm, and wherein the cover layer has a thickness that is in a range from 5 μm to 20 μm.

15. The antenna according to claim 12, further comprising:

an additional antenna element that is made of a conductive material and provided on the outer surface of the dielectric member to be at least partially covered by the cover layer; and an additional adhesive layer that is disposed between the additional antenna element and the dielectric member to adhere the additional antenna element onto the dielectric member, the additional adhesive layer being made of a fourth dielectric material, wherein the additional antenna element has a thickness that is not less than 10 μm, and wherein the additional adhesive layer has a thickness that is in a range from 5 μm to 20 μm.

16. The antenna according to claim 9, further comprising:

an additional antenna element that is made of a conductive material and provided on the outer surface of the dielectric member to be at least partially covered by the cover layer; and an additional adhesive layer that is disposed between the additional antenna element and the dielectric member to adhere the additional antenna element onto the dielectric member, the additional adhesive layer being made of a fourth dielectric material, wherein at least one of the antenna element and the additional antenna element is in close contact with the respective one of the adhesive layer and the additional adhesive layer by being interposed with an ink layer therebetween, the ink layer having a characteristic to grow plating.

17. A wireless communication device comprising:

casing means for accommodating electronic components, the casing means including a dielectric member made of a first dielectric material, and a cover layer made of a second dielectric material which covers an outer surface of the dielectric member;

wireless communication means for performing wireless communication, the wireless communication means being housed in the casing means;

antenna means for transmitting and receiving radio waves, the antenna means being electrically connected to the wireless communication means, the antenna means being made of a conductive material and provided on an inner surface of the dielectric member; and adhesive means for adhering the antenna means onto the dielectric member by being disposed between the antenna means and the dielectric member, the adhesive means being made of a third dielectric material.

18. An antenna comprising:

casing means for accommodating electronic components, the casing means including a dielectric member made of a first dielectric material, and a cover layer made of a second dielectric material which covers an outer surface of the dielectric member;

antenna means for transmitting and receiving radio waves, the antenna means being made of a conductive material and provided on an inner surface of the dielectric member; and adhesive means for adhering the antenna means onto the dielectric member by being disposed between the antenna means and the dielectric member, the adhesive means being made of a third dielectric material.

19. A wireless communication device comprising:

a case that includes a dielectric member made of a first dielectric material, and a cover layer made of a second dielectric material which covers an outer surface of the dielectric member;

a wireless communication circuit that is housed in the case;

an antenna element made of a conductive material and provided on the outer surface of the dielectric member between the dielectric member and the cover layer, the antenna element being electrically connected to the wireless communication circuit by a connection member that penetrates the case; and an adhesive layer that is disposed between the antenna element and the dielectric member to adhere the antenna element onto the dielectric member, the adhesive layer being made of a third dielectric material.

* * * * *